US010864142B2

(12) United States Patent
Spector

(10) Patent No.: US 10,864,142 B2
(45) Date of Patent: Dec. 15, 2020

(54) PILL SORTER AND COUNTING DEVICE

(71) Applicant: Ira Spector, Rydal, PA (US)

(72) Inventor: Ira Spector, Rydal, PA (US)

( * ) Notice: Subject to any disclaimer, the term of this patent is extended or adjusted under 35 U.S.C. 154(b) by 0 days.

(21) Appl. No.: 16/808,240

(22) Filed: Mar. 3, 2020

(65) Prior Publication Data

US 2020/0197262 A1 Jun. 25, 2020

Related U.S. Application Data

(63) Continuation of application No. 16/680,349, filed on Nov. 11, 2019, which is a continuation of application No. PCT/US2018/032098, filed on May 10, 2018.

(60) Provisional application No. 62/504,971, filed on May 11, 2017.

(51) Int. Cl.

| | |
|---|---|
| ***A61J 7/02*** | (2006.01) |
| ***B65D 83/04*** | (2006.01) |
| ***A61J 7/00*** | (2006.01) |

(52) U.S. Cl.

CPC ..... *A61J 7/02* (2013.01); *A61J 7/0069* (2013.01); *A61J 7/0084* (2013.01); *B65D 83/04* (2013.01)

(58) Field of Classification Search

CPC ..... A61J 7/02; A61J 2200/70; A61J 2205/40; A61J 1/03; A61J 7/0069

See application file for complete search history.

(56) References Cited

U.S. PATENT DOCUMENTS 728,869 A * 5/1903 Coghlan ..... B65D 1/023 222/572
1,608,939 A * 11/1926 Hogue ..... G03D 13/04 396/636
2,507,792 A * 5/1950 King ..... A61J 7/02 414/675
2,530,009 A 11/1950 Fields
2,575,919 A * 11/1951 Kautzmann ..... B42F 7/12 211/126.12
2,941,342 A 6/1960 Allen
2,945,473 A 7/1960 Robinson (Continued)

FOREIGN PATENT DOCUMENTS

WO 2018/209109 A3 11/2018
WO 2020/086897 A1 4/2020

OTHER PUBLICATIONS

International Search Report and Written Opinion, dated Nov. 29, 2018, for International Patent Application No. PCT/US2018/032098 filed on May 10, 2018.

(Continued)

*Primary Examiner* — Gregory W Adams

(74) *Attorney, Agent, or Firm* — K&L Gates LLP; Louis C. Cullman; Georgia N. Kefallinos

(57) ABSTRACT

Pill sorting devices are described herein that include a cavity formed from a bottom, a front, a first side wall, and a second side wall, a channel formed at the intersection of the first side wall and the second side wall, and a delivery channel within the front and first side wall or the within the front and the second side wall, wherein the delivery channel is offset from the channel. The pill sorting, counting, and dispensing device can be useful for people with arthritis or poor sight, or could be used commercially in pharmacies or industrially. Methods of making and using the pill sorting, counting, and dispensing devices are also described.

19 Claims, 6 Drawing Sheets

(56) References Cited

U.S. PATENT DOCUMENTS 3,255,894 A 6/1966 Van Handel et al.
3,747,756 A * 7/1973 Wheeler ..... B07C 7/04 209/703
D249,218 S * 9/1978 Mathison ..... D7/550.1
4,213,730 A 7/1980 Di Gaetano
4,802,599 A * 2/1989 Hill ..... F16N 31/004 141/331
5,067,530 A * 11/1991 Short, III ..... F16N 31/002 141/98
5,193,704 A * 3/1993 Kick ..... B65D 47/265 220/253
5,351,818 A 10/1994 Daneshvar
5,433,256 A * 7/1995 Vasers ..... B65B 39/007 141/332
5,480,072 A * 1/1996 Ripley ..... B67C 11/02 141/331
5,584,238 A * 12/1996 Newton, Sr. ..... A47J 43/284 141/331
6,386,367 B1 5/2002 Bayliss
6,821,079 B2 * 11/2004 Priebe ..... A61J 7/02 414/675
8,066,124 B2 * 11/2011 Koh ..... A61J 7/02 206/540
8,146,627 B2 * 4/2012 Mazur ..... A61J 1/03 141/240
8,331,877 B1 * 12/2012 Wilkinson ..... A47G 23/06 455/90.3
2010/0155411 A1 6/2010 Solari et al.
2010/0193396 A1 * 8/2010 Koh ..... A61J 7/02 206/528
2013/0302123 A1 11/2013 Connellan et al.
2017/0087059 A1 3/2017 Rodriguez et al.
2018/0125760 A1 5/2018 Chessa et al.
2020/0146941 A1 5/2020 Spector

OTHER PUBLICATIONS

International Search Report and Written Opinion, dated Feb. 4, 2020, for International Patent Application No. PCT/US2019/057940 filed on Oct. 24, 2019.

* cited by examiner

PILL SORTER AND COUNTING DEVICE

CROSS REFERENCE TO RELATED APPLICATIONS

This application is a continuation of U.S. patent application Ser. No. 16/680,349, filed on Nov. 11, 2019, which is a continuation of PCT/US2018/032098, filed May 10, 2018, which claims the benefit of U.S. provisional patent application No. 62/504,971, filed May 11, 2017, the entire disclosures of which are incorporated herein by reference.

FIELD

Devices used to sort pills are described herein.

BACKGROUND

With the dawning of every new drug, be it over the counter or prescription or synthetic or natural, comes a new pill to take according to a predefined schedule. People often use pill organizing boxes that have seven compartments, one for each day of the week to assist in organizing their medications. Some pill organizing boxes have a compartment for morning and a compartment for night.

Even for individuals with good sight and dexterity, loading pill organizing boxes can be a daunting task. For example, the box's compartments can be small and difficult to aim pills at, and some pills can simply be too difficult to handle. Problems can be compounded when a person has an ailment such as poor sight or arthritis.

SUMMARY

Described herein generally are devices that can assist with the counting, dispensing, sorting and/or loading of pills, for example into pill organizing boxes. The devices can also be used by pharmacies or in other commercial applications for counting, organizing, sorting, dispensing, loading, and/or organizing pills.

In some embodiments, the devices can be used to sort and separate pills. In some embodiments, the devices can be used to sort and/or count pills into a separate container(s). In one embodiment, the devices can be used to sort and/or count pills into a weekly pill box having at least one separate compartment for each day of the week.

In some embodiments, a pill sorting device is described that includes a cavity formed from a bottom, a front, a first side wall, and a second side wall, a channel formed at the intersection of the first side wall and the second side wall, and a delivery channel within the front and first side wall or the within the front and the second side wall, wherein the delivery channel is offset from the channel.

In some embodiments, the delivery channel is circular. In other embodiments, the delivery channel is square or triangular. The delivery channel can include a ridge that prevents pills from falling out of the cavity without force from a user.

In some embodiments, the first side wall and the second side wall each have a lip. The back can also have a lip is some embodiments.

The pill sorting device can have a length of about 10 cm to about 20 cm.

The pill sorting device can be formed of a polymer. In other embodiments, the pill sorting device can be formed of a metal or a combination of a metal and a polymer. In some embodiments, the pill sorting device can be formed of a rigid plastic.

In some embodiments, at least one of the bottom, the front, the first side wall, or the second side wall are at least partially transparent.

The bottom of the pill sorting device can be square or triangular.

In some embodiments, the channel extends from a back wall to a front portion.

In some embodiments, the front of the pill sorting device includes a first wall with an indentation. The indentation can assist a user is seeing where the delivery channel is aimed.

In some embodiments, the pill sorting device further includes a delivery chute extending down from the delivery channel. The delivery chute can include a proximal end that is larger in diameter than a distal end. In some embodiments, the delivery channel has a diameter and wherein the diameter of proximal end of the delivery chute matches a diameter of the delivery channel.

The pill sorting devices can also include a magnifying device. In some embodiments, the magnifying device is associated with the first side wall, the second side wall, or a combination thereof.

Kits including the herein described pill sorting devices are also described. In one embodiment, a kit is described including a pill sorting device as described herein, a pill box, and instructions for use. In some embodiments, a kit is described including a pill sorting device as described herein, a pill funnel, and instructions for use. In some embodiments, a kit is described including a pill funnel, a pill box, and instructions for use.

Methods of using the pill sorting devices described herein are also provided. The methods can include the step of advancing a pill through a delivery channel of a pill sorting device. The pill sorting device can include a channel formed at the intersection of a first side wall and a second side wall, and the delivery channel within the first side wall or the second side wall, wherein the delivery channel is offset from the channel.

In some embodiments, the method can include the step of aligning pills which includes the pill in the channel with the pill closest to the delivery channel.

In some embodiments, the method can include the step of aligning the delivery channel with a compartment in a pill box.

In some embodiments, the method can include the step of dropping the pill from the delivery channel into the compartment.

DRAWINGS

DETAILED DESCRIPTION

Figure 1:
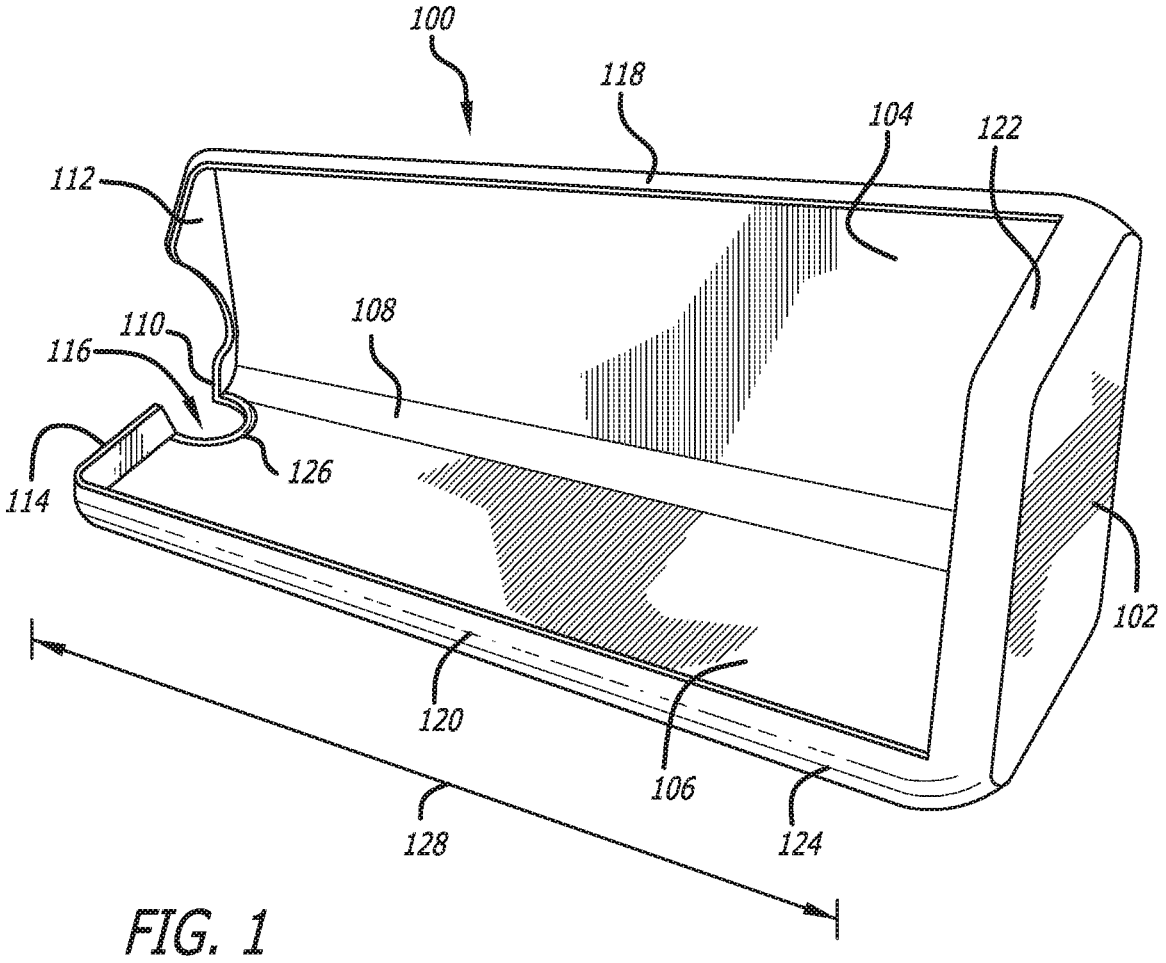
FIG. 1 illustrates a perspective view of a pill sorting device, or pill sorter, as described herein.

Described herein generally are pill sorting and/or dispensing and/or separating devices. These devices will be referred to herein as pill sorting devices or pill sorters. In some embodiments, the devices can be used to sort and/or count pills into a separate container(s). In one embodiment, the devices can be used to sort and/or count pills into a weekly pill box having at least one separate compartment for each day of the week.

Pill boxes can have any number of compartments that, in some embodiments, open and close using a door or hatch. Pill boxes can have one, two, three, four, five, six, seven, eight, nine, ten, 11, 12, 13, 14, 15, 16, 17, 18, 19, 20, 21, or more compartments. In some embodiments, pill boxes can have different overall shapes and/or different compartment shapes. Pill boxes can have overall circular, square, rectangular, triangular, oval, elliptical, or trapezoidal shape or other rectilinear shape. Further, each compartment within a pill box can have a circular, square, rectangular, triangular, oval, elliptical, or trapezoidal shape or other rectilinear shape.

The term pill can includes capsules, tablets and other solid forms of drug substances of various shapes and sizes. Pills can be solid or filled with liquids, gels, semi-solids, or the like.

While embodiments described herein illustrate the use of the devices for the sorting, counting and organizing of pills, the devices can also be used for other items such as, but not limited to, small mechanical parts (screws, nuts, washers, bearings, etc.), candies and food products, and other physical items such as pellets, granules, beads, etc. that lend themselves to the described embodiments.

In one embodiment, pill sorter 100 is described. Pill sorter 100 includes a cavity formed from bottom 102, a first side wall 104, and a second side wall 106. At the intersection of first side wall 104 and second side wall 106 exists a channel 108. Channel 108 can extend from bottom 102 to front 110.

Front 110 can include a first wall 112 that extends along at least a portion of front end of first side wall 104. Front 110 can also include a second wall 114 that extends along at least a portion of the front end of second side wall 106. In a portion of second side wall 106 not including second wall 114, a delivery channel 116 extends into second side wall 106.

Delivery channel 116 can have any shape that can assist in the delivery of pills from pill sorter 100 into an appropriate container. In some embodiments, delivery channel 116 can be circular. In other embodiments, delivery channel can be triangular, oval, or any other rectilinear shape. In circular embodiments, delivery channel can have a diameter of between about 1 mm and about 10 mm, between about 1 mm and about 9 mm, between about 1 mm and about 8 mm, between about 1 mm and about 7 mm, between about 1 mm and about 6 mm, between about 1 mm and about 5 mm, between about 1 mm and about 4 mm, between about 1 mm and about 3 mm, or between about 1 mm and about 2 mm.

First side wall 104 can also include a first lip 118 that extends from bottom 102 to front 110 and second side wall 106 can include a second lip 120 that extends from bottom 102 to front 110. In some embodiments, first lip 118 and second lip 120 can have various heights depending on a particular application. Heights of first lip 118 and second lip 120 can each independently be between about 1 mm and about 10 mm, between about 1 mm and about 9 mm, between about 1 mm and about 8 mm between about 1 mm and about 7 mm, between about 1 mm and about 6 mm, between about 1 mm and about 5 mm, between about 1 mm and about 4 mm, between about 1 mm and about 3 mm, or between about 1 mm and about 2 mm.

Bottom 102 can optionally include a back lip 122 that extends along periphery of bottom 102. In some embodiments, a purpose of first wall 112, second wall 114, first lip 118, second lip 120, and back lip 122 is to keep pills loaded within pill sorter 100 from falling out. In some embodiments, back lip 122 can have various heights depending on a particular application. The height of back lip 122 can be between about 1 mm and about 15 mm, between about 1 mm and about 14 mm, between about 1 mm and about 13 mm, between about 1 mm and about 12 mm, between about 1 mm and about 11 mm, between about 1 mm and about 10 mm, between about 1 mm and about 9 mm, between about 1 mm and about 8 mm, between about 1 mm and about 7 mm, between about 1 mm and about 5 mm, or between about 1 mm and about 5 mm.

Figure 2A:
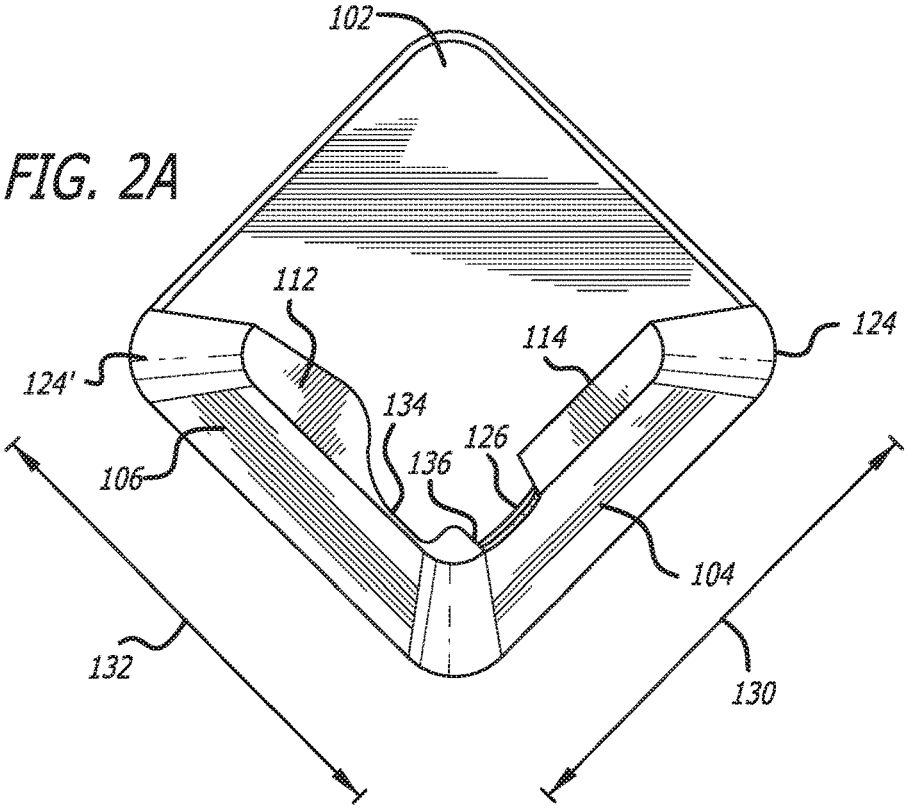
FIG. 2A is a front view of a right-handed pill sorter and FIG. 2B is a front view of a left-handed pill sorter.
Figure 2B:
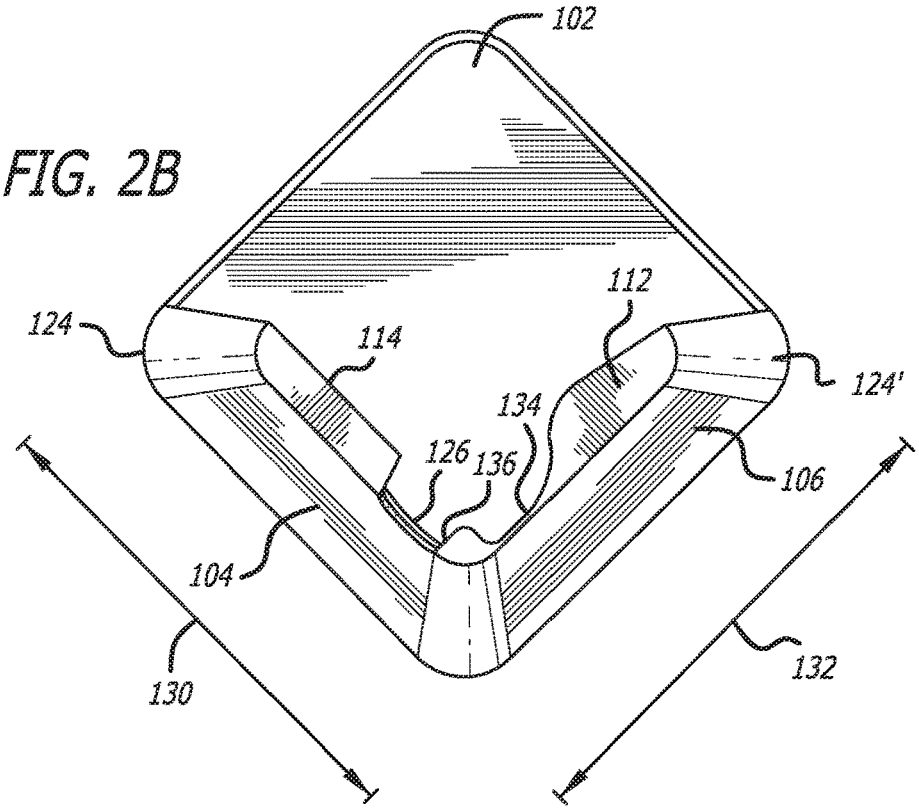

In another embodiment, first lip 118 and second lip 120 can be formed in such a configuration that allows for easy handling within a hand. In some embodiments, first lip 118 and second lip 120 can be formed for use with arthritic hands for easy grip such as with a curved edges 124, 124'. To enhance grip, first lip 118 and second lip 120 can be provided with special gripping materials and or grooves for better grip. In some embodiments, first lip 118 and second lip 120 can have a rounded configuration as most easily illustrated in FIGS. 2A and 2B.

In some embodiments, delivery channel 116 can also include a ridge 126. In some embodiments, ridge 126 can be referred to as a lip. Ridge 126 can keep pills within pill sorter 100, but still allow pills to fall out of delivery channel 116 when directed to do so by a user. In some embodiments, a ridge may not be needed.

Pill sorter 100 can have a length 128 which can vary depending on a particular application. Length 128 can be between about 10 cm and about 15 cm, between about 10 cm and about 20 cm, between about 10 cm and about 25 cm, between about 10 cm and about 30 cm, between about 5 cm and about 30 cm, between about 5 cm and about 20 cm, between about 10 cm and about 40 cm, or between about 10 cm and about 35 cm.

Pill sorter 100 can have a first width 130 and a second width 132, each of which can vary depending on a particular application. First width 130 and second width 132 can each independently be between about 2 cm and about 10 cm, between about 2 cm and about 5 cm, between about 5 cm and about 10 cm, between about 2 cm and about 6 cm, between about 2 cm and about 7 cm, between about 2 cm and about 8 cm, between about 2 cm and about 9 cm, or between about 3 cm and about 10 cm.

Pill sorters can be formed of any appropriate material that is strong enough to hold its shape even when filled with pills. In some embodiments, the pill sorter is formed of plastic or other appropriate polymer. In other embodiments, polymers include, but are not limited to polyurethanes, silicones, polyesters such as polyolefins, polyisobutylene and ethylene-alphaolefin copolymers; acrylic polymers and copolymers, ethylene-co-vinylacetate, polybutylmethacrylate, vinyl halide polymers and copolymers, such as polyvinyl chloride; polyvinyl ethers, such as polyvinyl methyl ether; polyvinylidene halides, such as polyvinylidene fluoride and polyvinylidene chloride; polyacrylonitrile, polyvinyl ketones; polyvinyl aromatics, such as polystyrene, polyvinyl esters, such as polyvinyl acetate; copolymers of vinyl monomers with each other and olefins, such as ethylene-methyl methacrylate copolymers, acrylonitrile-styrene copolymers, ABS resins, and ethylene-vinyl acetate copolymers; polyamides, such as Nylon 66 and polycaprolactam; alkyd resins; polycarbonates; polyoxymethylenes; polyimides;

polyethers; epoxy resins, polyurethanes; rayon; rayon-triacetate; cellulose, cellulose acetate, cellulose butyrate; cellulose acetate butyrate; cellophane; cellulose nitrate; cellulose propionate; cellulose ethers; carboxymethyl cellulose; synthetic and natural rubbers such as polysiloxanes, latex, polymerized isoprene, bromo isobutylene isoprene, chloro isobutylene isoprene, polychloroprene, chlorosulphonated polyethylene, ethylene propylene, ethylene propylene diene monomer, fluoro silicone, hydrogenated nitrile butadiene, polyisoprene, isobutylene isoprene butyl, methyl vinyl silicone, acrylonitrile butadiene, acrylonitrile butadiene carboxy monomer, styrene butadiene, epichlorodydrin; and combinations thereof.

In some embodiments, the polymer or combination of polymers chosen to form the pill sorters are rigid enough to hold a particular configuration and perform its intended function. In some embodiments, the polymer used is a thermal set rigid plastic.

In other embodiments, the pill sorter can be formed of a metal or a metal alloy. In one embodiment, the pill sorter is formed of stainless steel. Other metals can include, but are not limited to, brass, steel, iron, aluminum, copper, zinc, alloys thereof, or combinations thereof.

In addition to material(s) used to form the herein described pill sorters, each can be colored as appropriate for a particular application. Pill sorters can be solid colored, striped, spotted, or a combination thereof. Further, pill sorters can include logos, slogans, pictures, trademarks, designs, or the like, or a combination thereof.

In some embodiments, pill sorters are made of a transparent, or at least partially transparent, material that allows better visualization of the contents of the pill sorter.

In some embodiments, at least one of bottom 102, first side wall 104, and second side wall 106 is flat and/or flat enough to allow a pill sorter to be stood up on one or more of these surfaces.

In some embodiments, bottom 102 can have various shapes depending on a particular application. In one embodiment, as illustrated in FIGS. 1 and 2, bottom 102 has a generally square shape. In other embodiments, bottom 102 can be triangular, oval, or circular.

In some embodiments, front 110 can include an indentation 134 in first wall 112. Indentation can be included to allow a user to more clearly see where delivery channel 116 is aimed.

Further, in relation to front 110, delivery channel 116 can be offset from front corner 136 which blocks the end of channel 108. Delivery channel 116 can be offset from front corner 136 by between about 1 mm and about 10 mm, between about 1 mm and about 9 mm, between about 1 mm and about 8 mm between about 1 mm and about 7 mm, between about 1 mm and about 6 mm, between about 1 mm and about 5 mm, between about 1 mm and about 4 mm, between about 1 mm and about 3 mm, or between about 1 mm and about 2 mm.

Figure 3A:
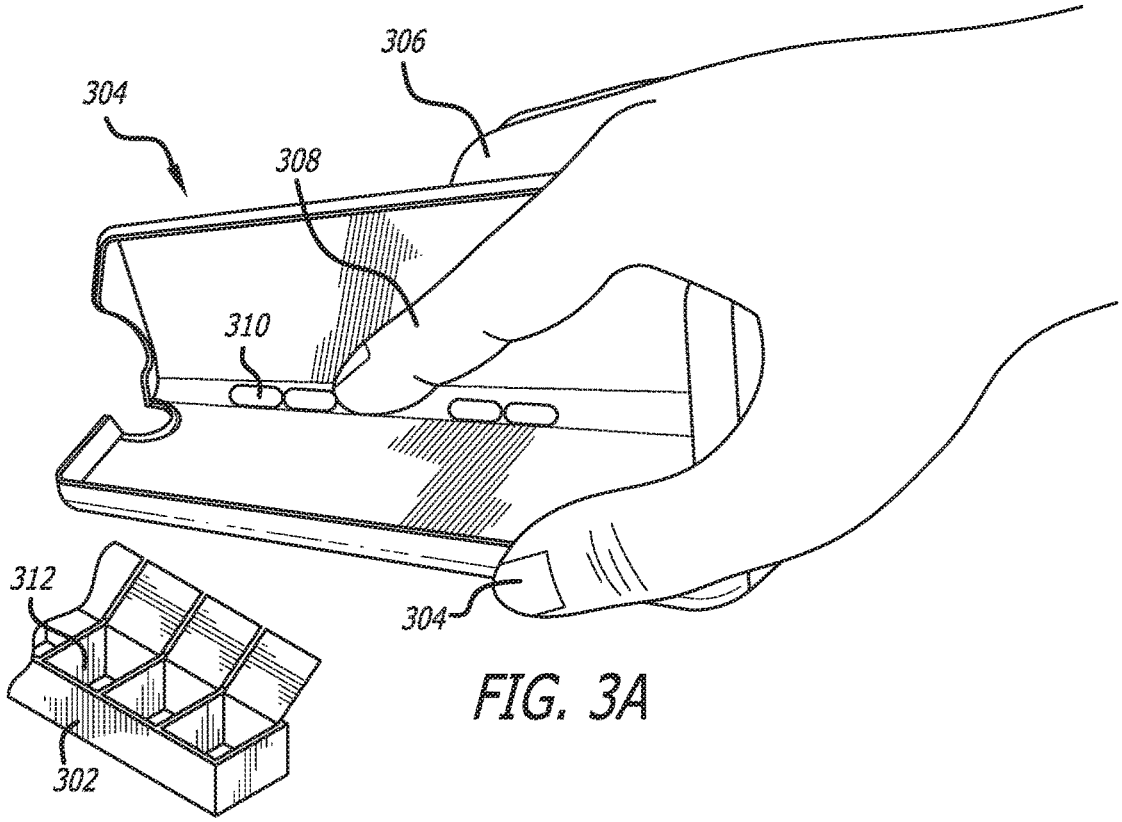
FIGS. 3A and 3B illustrate the use of a pill sorter as described herein to deliver a pill into a compartment of a pill box.

Pill sorters as described herein can be used to load pills into pill boxes. Pill boxes often come in a weekly pill box having a separate compartment for each day of the week. Such a pill box 302 and how one is loaded using pill sorter 100 is illustrated in FIGS. 3 A and 3B.

Pill sorter 100 can be gripped on first lip 118 by a user's thumb 304 and a least one of the user's fingers, such as his/her middle, ring, and/or pinky fingers 306 can rest and grip against second lip 120 and second side wall 106. The user's pointer finger 308 can be used to manipulate pills 310 disposed within pill sorter 100. In another embodiment, a spatula, stick or other device could be used to move the pills within the sorting device.

Figure 3B:
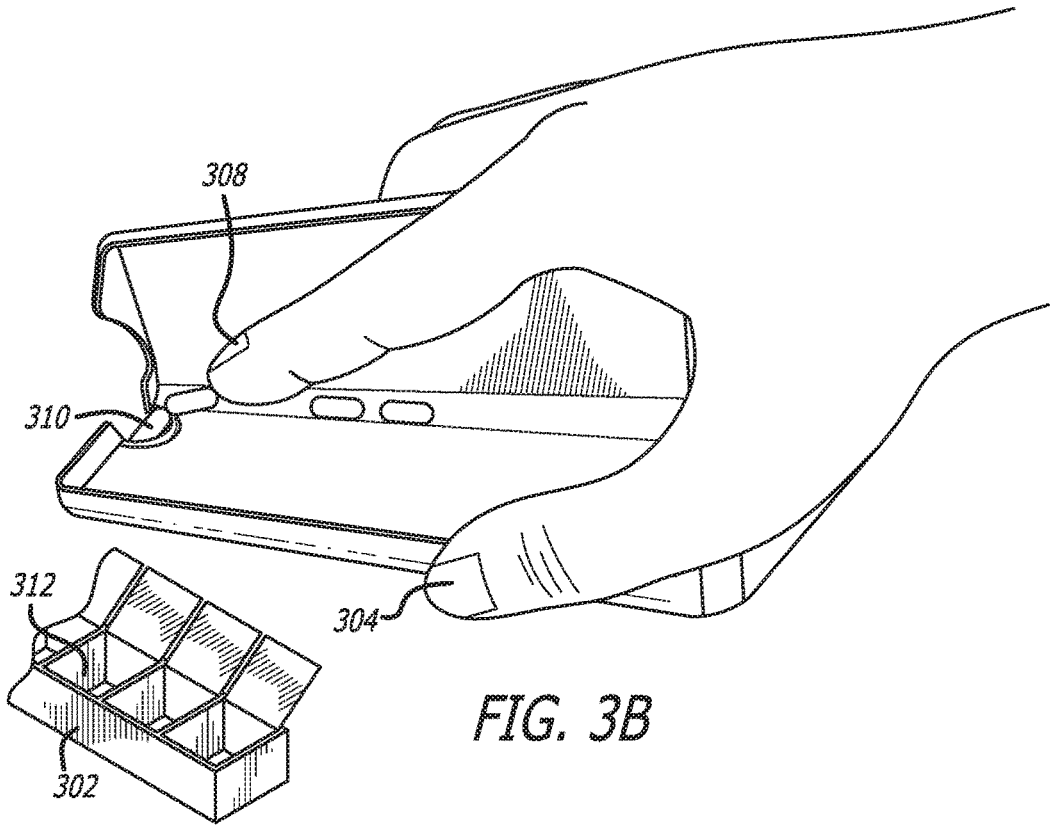

During use, channel 108 can be used to line up pills 310 along its length. When pill sorter 100 is lined up over a compartment 312, specifically, when delivery channel 116 is lined up over compartment 312, a pill nearest delivery channel 116 can be pushed over ridge 126 and down into compartment 312 (as shown in FIG. 3B). Then, subsequent pills can be moved into place next to delivery channel 116 for movement to pill box 302 in the same or a different compartment 312.

If more than one type of pill is within the pill sorter, a user can maneuver the pills within the pill sorter to line the pills up as needed for delivery into pill box 302.

Pill sorters as described herein can be used for combinations of pills. In some embodiments, a user can load several different types of pills into a pill sorter. The pill sorter can be used to drop particular pills into a pill container. A user's finger(s) can be used to easily maneuver correct pills out of the pill sorter and into a pill container.

Pill sorters as described herein can be used with virtually any size or shaped pill. Delivery channels can be cut to dimensions that accommodate, or do not accommodate, particular sized or shaped pills. In one embodiment, a delivery channel can be cut in a circular shape with a particular diameter. When pills are sorted using a pill sorter, only pills that are small enough or circular enough can fit through the delivery channel hole. This configuration can prevent unwanted pills from being loaded into a pill container.

Pill sorters described and illustrated herein may be shown with a particular handedness (e.g., right handed or left handed). Handedness is illustrated, for example, in FIGS. 2A and 2B. It is envisioned that the opposite handedness of any device or method described or illustrated herein is within the scope of the present specification.

Figure 4:
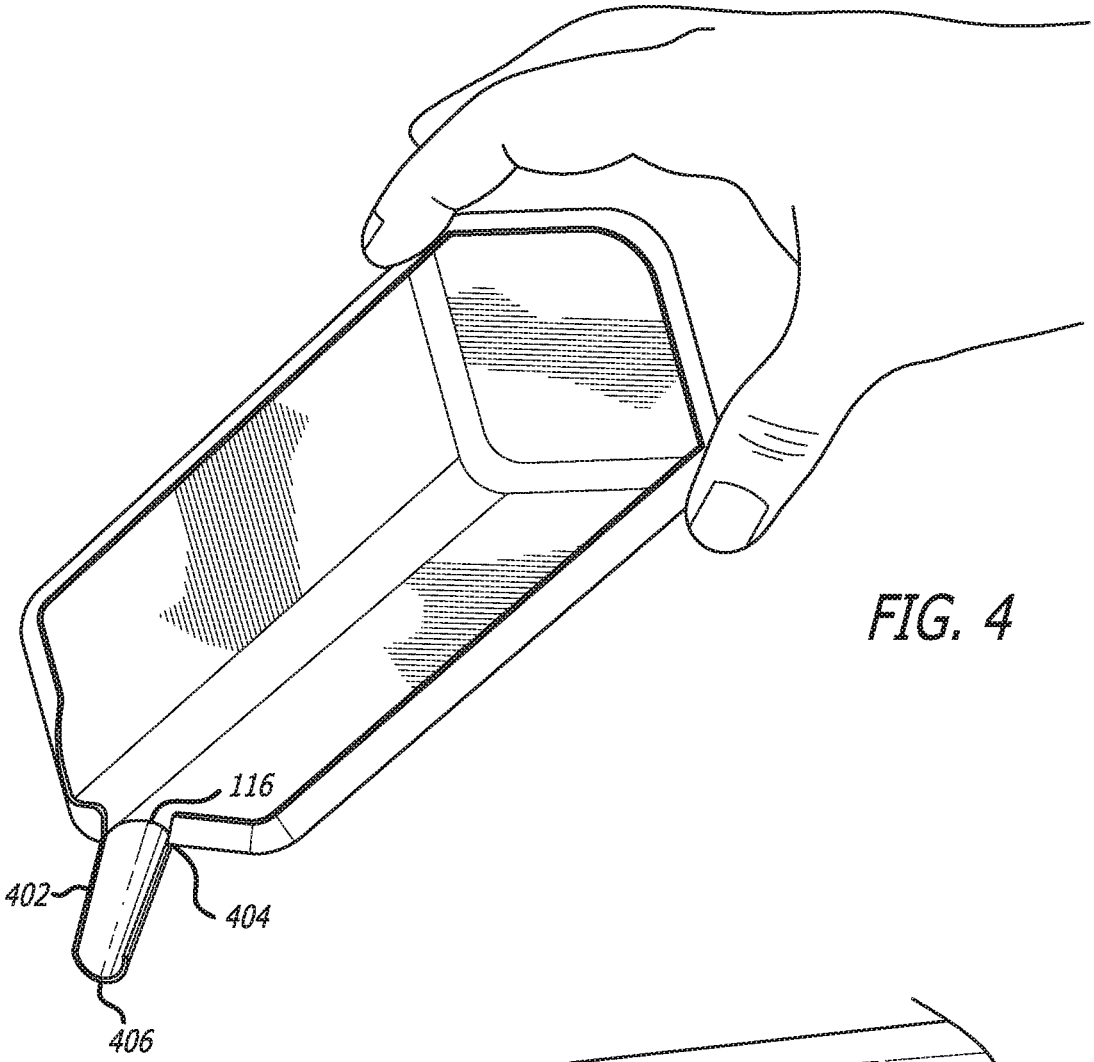
FIG. 4 illustrates another embodiment of a pill sorter including a delivery chute.
Figure 5:
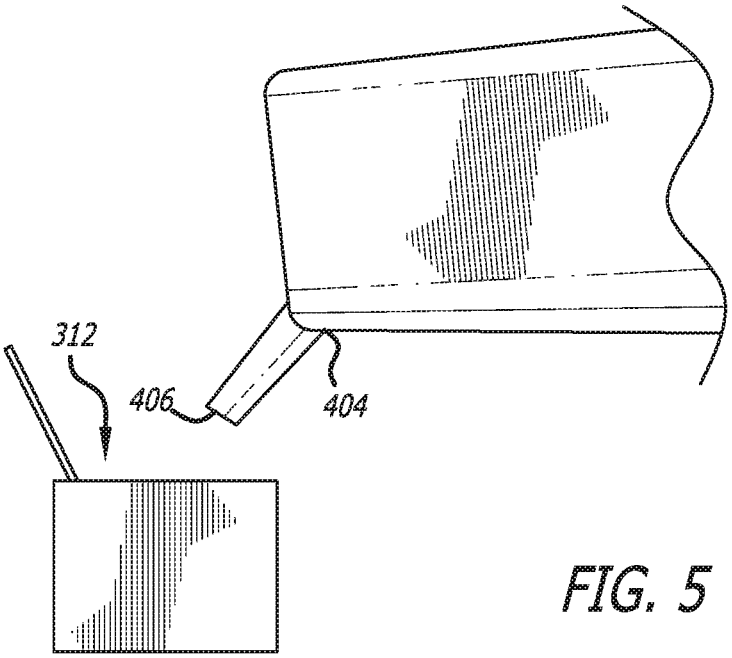
FIG. 5 illustrates the use of the delivery chute to deliver a pill into a compartment of a pill box.

In some embodiments, pill sorters described herein can be provided with a delivery chute 402 that extends down and away from delivery channel 116. Such a pill sorter, pill sorter 400 is illustrated in FIGS. 4 and 5. Delivery chute 402 can have a proximal end 404 that is larger in diameter than distal end 406. In one embodiment, the diameter of proximal end matches the diameter of delivery channel 116.

When a pill sorter is used that includes delivery chute 402, distal end 406 is placed near or in compartment 312. When a pill is advanced through delivery channel 116, the pill slides down delivery chute 402 and into compartment 312. Delivery chute 402 can prevent pills from missing an appropriate compartment.

In one embodiment, pill sorters described herein can include a magnifying device associated with and/or directed at channel 108, delivery channel 116, or both. In some embodiments, a magnifying device can extend between first lip 118 and second lip 120 and provide magnification of the entire inside of pill sorter 100. In some embodiments, the magnifying device hinges on either first lip 118 or second lip 120 to allow insertion of pills into the pill sorter and then reorientation of the magnification device. In another embodiment, a magnifying device can attach to first lip 118 and/or second lip 120 and be at a location above where a hand would hold the pill sorter.

Figure 6:
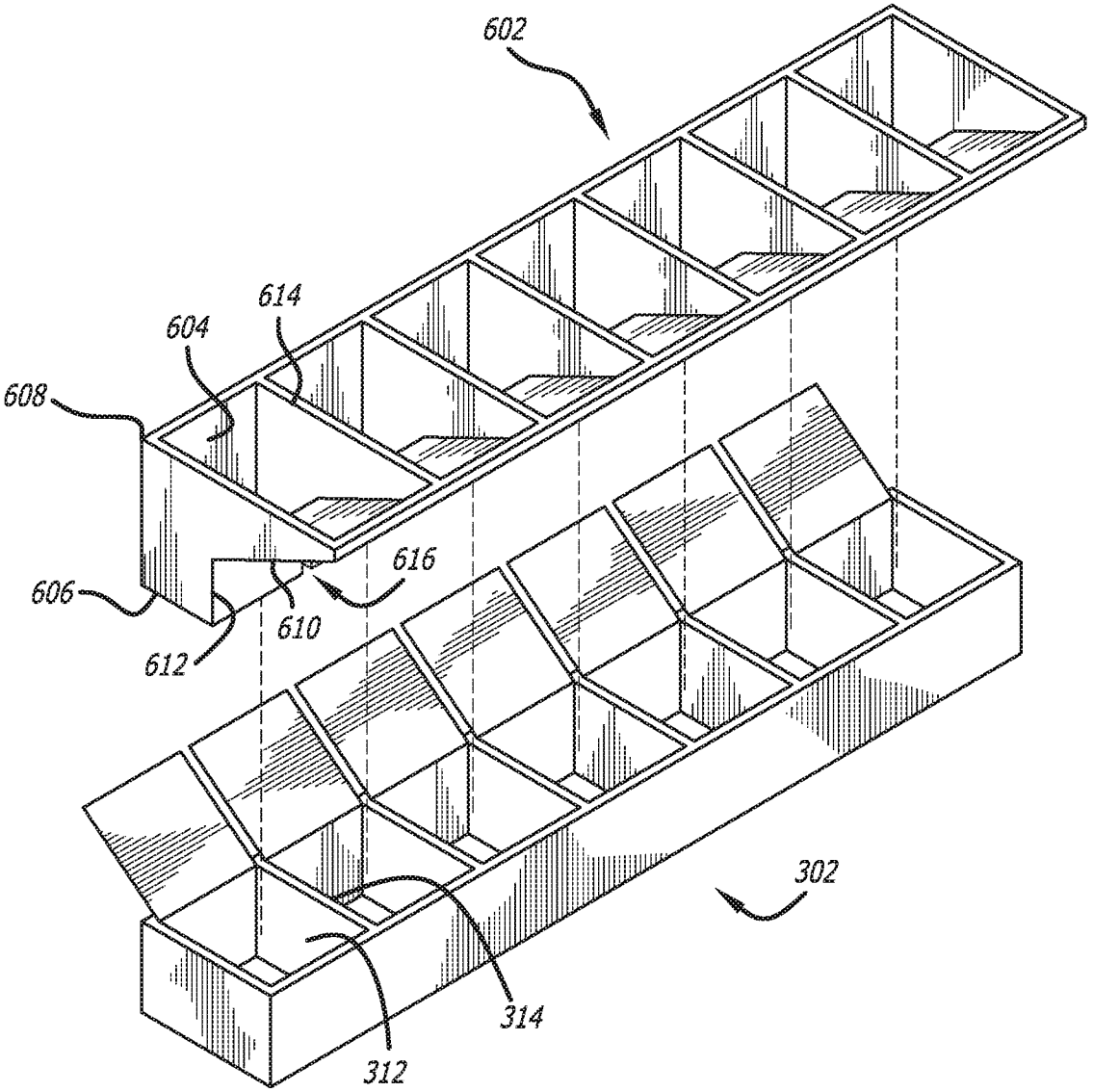
FIG. 6 illustrates a pill box funnel that can be used with a pill sorter as described herein.
Figure 7:
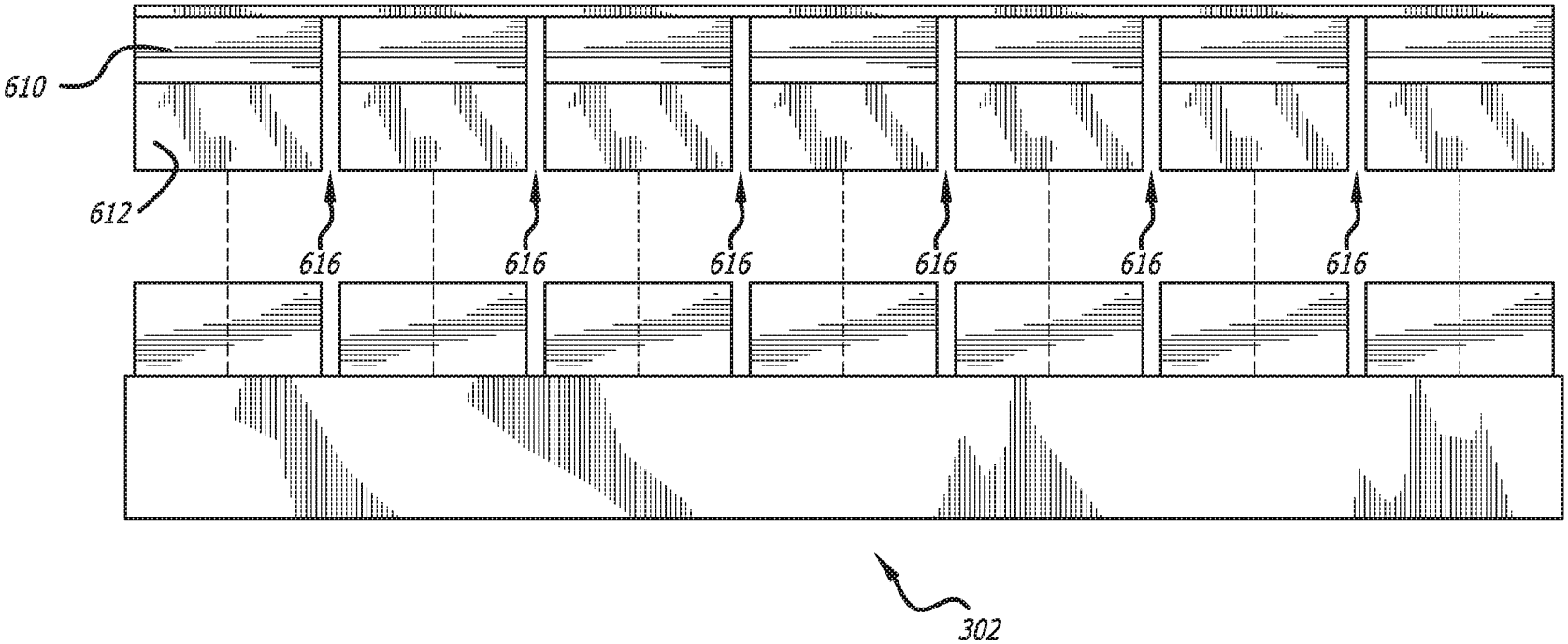
FIG. 7 is a side view of the pill box and pill box funnel of FIG. 6.

Another accessory for use with or without a pill sorter as described herein, either with or without a delivery chute, is illustrated in FIG. 6 and FIG. 7. Pill box funnel 602 includes at least one funnel 604 that provides a larger delivery surface area than compartment 312. Pill box funnel 602 includes a bottom end 606 that fits within compartment 312. Top end 608 of pill box funnel 602 has a larger area that bottom end 606. Pill box funnel 602 then includes a tapered portion 610 that transitions between top end 608 and bottom end 606. In some embodiments, tapered portion 610 only extends partially down pill box funnel 602 thereby providing a nesting portion 612 that fits inside compartment 312.

In some embodiments, nesting portion 612 can be sized to fit within compartment 312 and engage in a friction fit that holds pill box funnel 602 in pill box 302.

In some embodiments, pill box funnel 602 can include seven funnels. Each of the seven funnels can be attached on a side portion 614 such that each tapered portion 610 extends outward away from the pill box's lid(s). However, in some embodiments, each funnel can include two opposite facing tapered portions, one that extends away from the lid(s) and another than extends over the lids.

Each set of funnels attached at side portion 614 can include a space 616 between adjacent nesting portions that allows for insertion over barrier 314.

Pill box funnel 602 can be formed of any polymer, metal or combination thereof described herein. In some embodiments, pill box funnel 602 is formed of plastic. In some embodiments, pill box funnel 602 can be at least partially transparent thereby allowing easier visualization of the pill box through the funnel.

Kits can include various combinations of the herein described devices. In one embodiment, a kit can include a pill sorter, a pill box, and instructions for use.

In another embodiment, a kit can include a pill sorter, a pill box, a pill funnel, and instructions for use.

In still another embodiment, a kit can include a pill box, a pill funnel, and instructions for use.

EXAMPLES

Example 1

Bob has severe rheumatoid arthritis and sorting his weekly pill supply into commercially available weekly pill boxes is extremely challenging. Thus, Bob uses a pill sorter such as pill sorter 100. Bob takes five pills per day and each pill is of a different size. Bob can use pill sorter in one of two ways.

In a first way, Bob dumps seven of each type of pill into pill sorter. Using his pointer finger, Bob maneuvers a first pill of a certain type adjacent to the delivery channel. Bob lines up delivery channel with the Sunday compartment of a pill box. He then pushes the pill out of the delivery channel and into the Sunday compartment. He then maneuvers a second type of pill adjacent to the delivery channel and drops it out into the Sunday compartment. He repeats this process until the Sunday compartment includes all five of his pills. He then proceeds to fill the remaining days with his pills.

In a second way, Bob dumps a portion of a first type of pill into pill sorter. Using his pointer finger, Bob maneuvers a first pill adjacent to the delivery channel. Bob lines up delivery channel with the Sunday compartment of a pill box. He then pushes the pill out of the delivery channel and into the Sunday compartment. He then maneuvers a second type of pill adjacent to the delivery channel. He lines up the delivery channel with the Monday compartment and drops the second pill into the Monday compartment. He repeats this process until all the compartments include a pill. He then pours the remaining pills from the pill sorter back into their bottle. Bob repeats this process with different types of pills until his pill box is completed for the week.

Example 2

Jenny has poor eyesight and has trouble properly dropping pills into the small compartments in commercially available weekly pill boxes. Thus, Jenny uses a pill box funnel such as pill box funnel 602. Jenny takes two pills per day and each pill is of a different size. Jenny opens all the compartments in her pill box and inserts the pill box funnel.

Jenny dumps a portion of a first type of pill into her left hand. Using her right hand, Jenny grasps a first pill and drops the pill into the larger opening of the pill box funnel for the Sunday compartment. The pill falls down the funnel and into the Sunday compartment. She then proceeds to repeat this process for the reaming compartments. She then pours the remaining pills back into their bottle. Jenny repeats the process with her second type of pill.

When done, Jenny removes the pill box funnel, snaps dosed all the compartments, and drops the pill box in her drawer.

The preceding disclosures are illustrative embodiments. It should be appreciated by those of skill in the art that the devices, techniques and methods disclosed herein elucidate representative embodiments that function well in the practice of the present disclosure. However, those of skill in the art should, in light of the present disclosure, appreciate that many changes can be made in the specific embodiments that are disclosed and still obtain a like or similar result without departing from the spirit and scope of the invention.

Unless otherwise indicated, all numbers expressing quantities of ingredients, properties such as molecular weight, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

The terms "a" and "an" and "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided herein is intended merely to better illuminate the invention and does not pose a limitation on the scope of the invention otherwise claimed. No language in the specification should be construed as indicating any non-claimed element essential to the practice of the invention.

The use of the term "or" in the claims is used to mean "and/or" unless explicitly indicated to refer to alternatives only or the alternatives are mutually exclusive, although the disclosure supports a definition that refers to only alternatives and "and/or."

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is herein deemed to contain the group as modified thus fulfilling the written description of all Markush groups used in the appended claims.

Preferred embodiments of this invention are described herein, including the best mode known to the inventors for carrying out the invention. Of course, variations on those preferred embodiments will become apparent to those of ordinary skill in the art upon reading the foregoing description. The inventor expects those of ordinary skill in the art to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of the invention so claimed are inherently or expressly described and enabled herein.

Further, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

I claim:

1. A pill sorting device including a cavity formed from a bottom, a front, a first side wall, and a second side wall, a channel formed at the intersection of the first side wall and the second side wall, and a delivery channel within the front and the first side wall or within the front and the second side wall, wherein the delivery channel is offset from the channel, and includes a ridge configured to dispense a pill by exiting the delivery channel, wherein the first side wall and second side wall are generally L-shaped, and wherein the bottom adjoins the first side wall and second side wall and is generally square shaped.

2. The pill sorting device of claim 1, wherein the delivery channel is circular.

3. The pill sorting device of claim 1, wherein the first side wall and the second side wall each have a lip.

4. The pill sorting device of claim 1, wherein the bottom has a lip.

5. The pill sorting device of claim 1, having a length between 10 cm to 20 cm.

6. The pill sorting device of claim 1, formed of a polymer.

7. The pill sorting device of claim 1, wherein at least one of the bottom, the front, the first side wall, or the second side wall are at least partially transparent.

8. The pill sorting device of claim 1, wherein the bottom is square or triangular.

9. The pill sorting device of claim 1, wherein the front includes a first wall with an indentation.

10. The pill sorting device of claim 1, further including a delivery chute extending down from the delivery channel.

11. The pill sorting device of claim 10, wherein the delivery chute includes a proximal end that is larger in diameter than a distal end.

12. The pill sorting device of claim 11, wherein the delivery channel has a diameter and wherein the diameter of proximal end of the delivery chute matches a diameter of the delivery channel.

13. A kit including a pill sorting device of claim 1, a pill box, and instructions for use.

14. A kit including a pill sorting device of claim 1, a pill box, a pill funnel, and instructions for use.

15. A method of sorting and dispensing a pill into a pill box, the method comprising:

providing the apparatus of claim 1, lining up a pill along a length of a channel, advancing the pill along the length of the channel to a delivery channel including a ridge of a pill sorting device, pushing the pill over the ridge whereby the pill exits the delivery channel, wherein the channel of the pill sorting device is formed at the intersection of a first side wall and a second side wall, and the delivery channel is within the first side wall or the second side wall, wherein the delivery channel is offset from the channel.

16. The method of claim 15, further including aligning pills which includes the pill in the channel with the pill closest to the delivery channel.

17. The method of claim 15, further including aligning the delivery channel with a compartment in a pill box.

18. The method of claim 17, further including dropping the pill from the delivery channel into the compartment.

19. The method of claim 15, wherein the channel extends from a back wall to a front portion.

* * * * *